US007380661B2

(12) United States Patent
Gibler et al.

(10) Patent No.: US 7,380,661 B2
(45) Date of Patent: Jun. 3, 2008

(54) PACKAGING FOR LIGHTING EQUIPMENT

(75) Inventors: Zachary Gibler, Granville, OH (US); David Henderson, Oxford, GA (US)

(73) Assignee: Acuity Brands, Inc., Atlanta, GA (US)

( * ) Notice: Subject to any disclaimer, the term of this patent is extended or adjusted under 35 U.S.C. 154(b) by 259 days.

(21) Appl. No.: 11/200,961

(22) Filed: Aug. 10, 2005

(65) Prior Publication Data

US 2007/0080079 A1 Apr. 12, 2007

(51) Int. Cl.
*B65D 85/42* (2006.01)

(52) U.S. Cl. ..... 206/421; 206/500; 206/509; 53/467; 220/23.4; 220/23.6

(58) Field of Classification Search ..... 206/418–422, 206/525, 526, 585, 591–594, 486, 490, 503, 206/504, 509; 362/253, 431; 220/4.21, 220/23.4, 23.6; 53/452, 467, 468, 471, 473
See application file for complete search history.

(56) References Cited

U.S. PATENT DOCUMENTS

| | | | | |
|---|---|---|---|---|
| 1,861,206 | A * | 5/1932 | Burgess | 206/419 |
| 1,933,338 | A * | 10/1933 | Plishker | 206/419 |
| 1,934,566 | A | 11/1933 | Solomon | |
| 3,158,261 | A | 11/1964 | Stiffel | |
| 3,661,685 | A * | 5/1972 | Osteen | 362/431 |
| 3,679,891 | A * | 7/1972 | Quack | 362/431 |
| 4,020,606 | A | 5/1977 | Pratt | |
| 4,128,171 | A | 12/1978 | Evans | |
| 4,199,072 | A | 4/1980 | Jacks | |
| 4,257,211 | A | 3/1981 | Fales et al. | |
| 4,384,316 | A * | 5/1983 | de Vos et al. | 362/431 |
| 5,782,354 | A | 7/1998 | Genix | |
| 5,850,922 | A | 12/1998 | Fraser | |
| 6,298,989 | B1 | 10/2001 | Chu | |
| 6,419,085 | B1 | 7/2002 | Humphrey | |
| 2002/0125163 | A1 | 9/2002 | Chou | |

FOREIGN PATENT DOCUMENTS

| | | |
|---|---|---|
| JP | 3133768 | 6/1991 |
| JP | 3256860 | 11/1991 |
| JP | 3256863 | 11/1991 |

* cited by examiner

*Primary Examiner*—Luan K Bui
(74) *Attorney, Agent, or Firm*—Kilpatrick Stockton, LLP

(57) ABSTRACT

Packaging and delivery systems and methods for lighting devices such as streetlights. One embodiment of the invention includes a lighting device packaging and delivery system for a partially or completely preassembled and pre-wired luminaire and pole. The packaging and methods allow the unit to be shipped and installed with very little or no assembly required. The unit, or multi-pack of units, may be packaged with all of the required components, such as the photo control and lamp, already installed.

20 Claims, 3 Drawing Sheets

PACKAGING FOR LIGHTING EQUIPMENT

FIELD OF THE INVENTION

The present invention relates to packaging, and particularly, relates to packaging and delivery of large lighting devices and equipment.

BACKGROUND OF THE INVENTION

Outdoor lighting devices, such as streetlights, are commonly used to aid automobile and pedestrian safety at night and in unfriendly weather conditions. A streetlight is typically a raised lamp near the edge of a street that is turned on or lighted at a certain time each night. Streetlights may also have light-sensitive photocells that turn them on and off automatically, for example, on at dusk or in bad weather and off at sunrise. Streetlights typically include, or attach to, a pole or other structure to raise them above the ground. Such poles can have lengths exceeding 20 feet. In many cases, the light or lights at the top of a streetlight pole are connected to an electricity source through electrical wiring that runs down through the pole.

Lighting devices often require a significant amount of assembly, installation, and setup after delivery. Assembling and electrically connecting components can be time-consuming and may require the assistance of an expert, technician, or electrician. The need for electrical expertise and assembly is even more common and burdensome for larger lighting devices, such as streetlights, which are usually shipped in a partially unassembled manner because of their size or shape. When the pole, lamps, and other components of a streetlight are shipped or delivered in unassembled form, a significant amount of time and effort may be required to properly assemble and electrically connect the various components. In some cases, this work must be done at the top of a pole high above ground level, requiring additional equipment such as ladders and high-reach trucks.

The components of large lighting devices such as streetlights are commonly ordered separately from one another. Past ordering methods have involved having a purchaser place individual purchase orders for each of a lamp, a control, a luminaire, a pole, and wiring. The separate ordering of the lighting device's components typically requires additional effort in order to coordinate shipment schedules such that the materials will arrive at the same time. Additionally, there is a risk that one or more of the components will not arrive at its scheduled delivery time, delaying the installation of the lighting device.

SUMMARY OF THE INVENTION

One embodiment of the present invention includes a package for a lighting device that includes an encasing structure that surrounds at least a portion of a luminaire of the lighting device. An aperture in the encasing structure is configured to allow a pole connected to the luminaire to extend from the encasing structure. Another embodiment of the present invention includes a method of packaging a lighting device that includes encasing the luminaire of the lighting device with an encasing structure of a package such that a pole of the lighting device extends through an aperture. A third embodiment of the present invention includes a method of selling a lighting device that includes offering for sale a lighting device, which includes a luminaire preassembled to a pole, under a single item code, accepting an order for the single item code for delivery to a delivery location, and shipping the lighting device to the delivery location.

DETAILED DESCRIPTION OF THE INVENTION

Introduction

One embodiment of the invention includes a lighting device packaging and delivery system for a partially or completely preassembled and pre-wired luminaire and pole. The packaging allows the unit to be shipped and installed with very little or no assembly required. The unit, or multi-pack/bundle of units, may arrive at the destination with all of the required components, such as the photocontrol and lamp, already installed. Upon arrival, the installer will remove the packaging protecting the luminaire and possibly some wrapping protecting a pole, orient the fixture in the proper direction if needed, and lower it into the prepared hole for the direct burial pole. The supply wiring is pulled through the proper openings in the pole base, the wiring is connected, and pole installation is completed. In some embodiments, the packaging is designed to interlock with other units of the same type to form a multi-pack or bundle. For example, the packaging may have one or more recesses to allow adjacent luminaires or poles of other lighting devices to be secured.

Exemplary Embodiment of a Packaged Lighting Device

Figure 1:
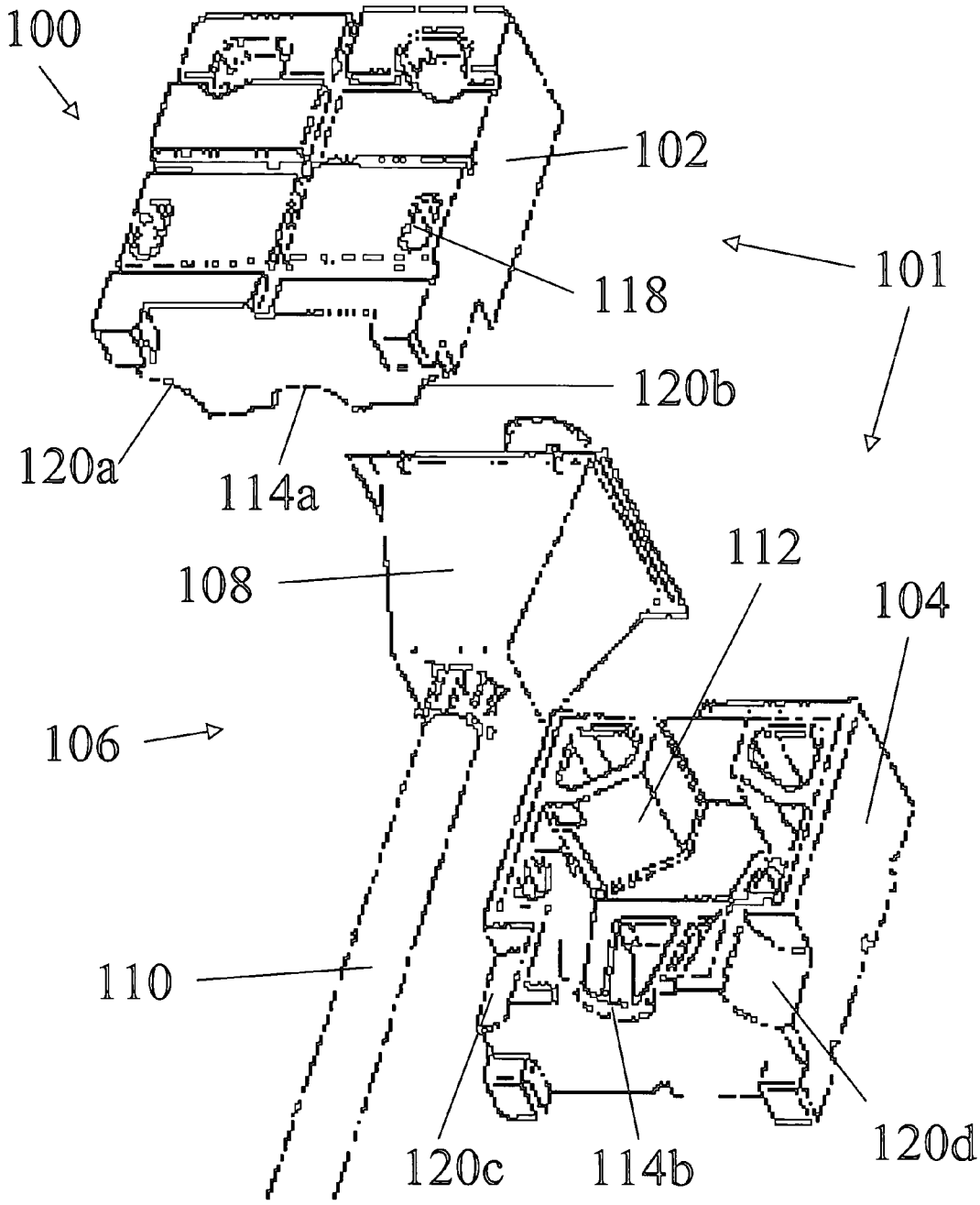
FIG. 1 shows an exemplary packaging for a lighting device in accordance with an embodiment of the present invention.
Figure 2:
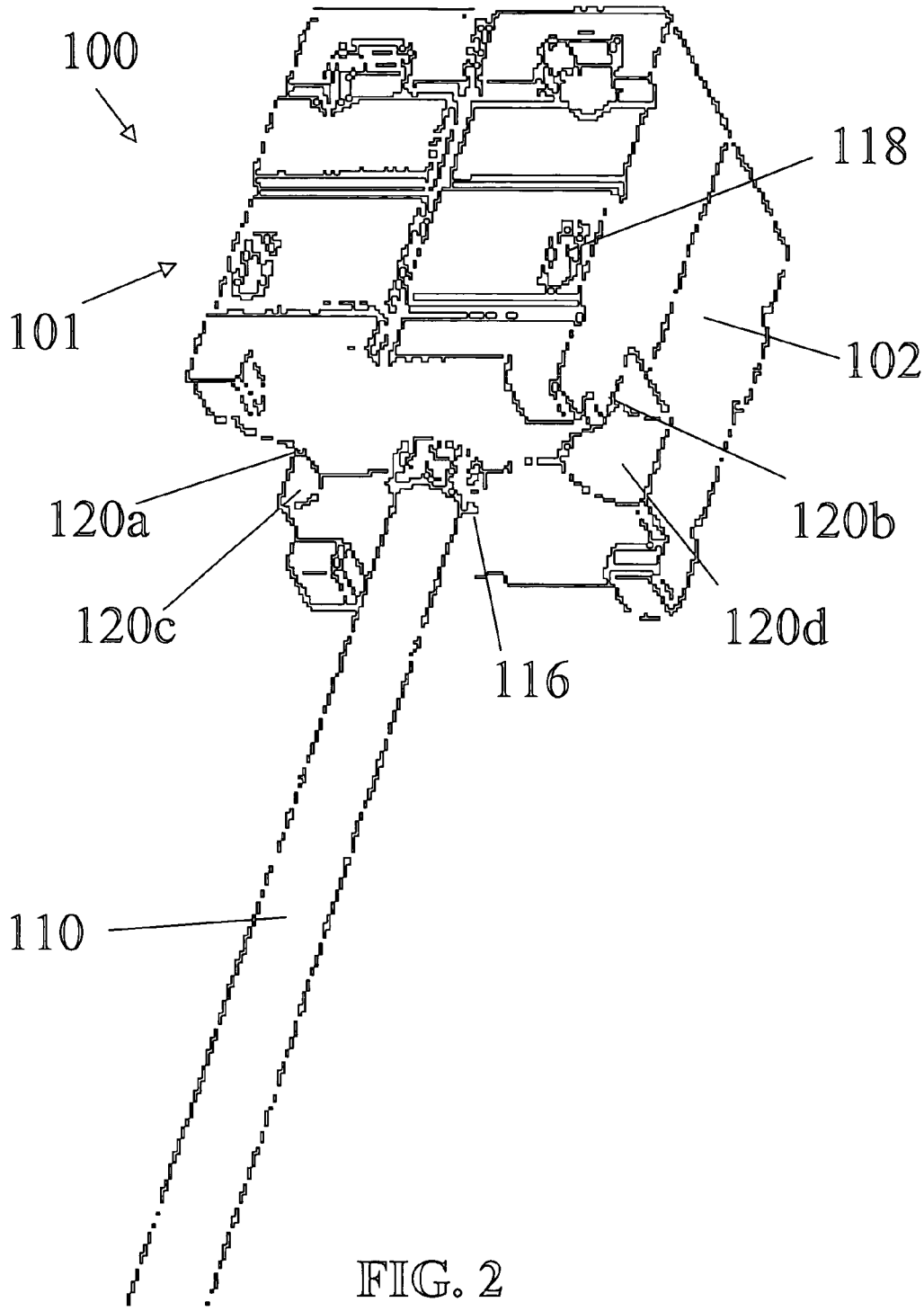
FIG. 2 shows the exemplary packaging for the lighting device of FIG. 1 with the first and second portions assembled around the luminaire.

FIGS. 1 and 2 show a packaged lighting device 100. An encasing structure 101 having a first portion 102 and second portion 104 is used to package, ship, deliver, store, and/or display lighting device 106. The encasing structure 101 may have a rectangular outer shape, a square outer shape, or any other suitable shape, and may be composed of two separable portions 102, 104, as shown, or of any suitable number of components or pieces. As shown, in this embodiment, the two portions 102, 104 of the encasing structure 101 encase primarily the luminaire 108 of the lighting device 106, and allow the pole 110 to extend outward from the packaging. Note that the term "pole" is not limited to any particular shape or size. Any suitable extending structure may be used. In some cases, the lighting device 106 will be a streetlight with a pole 110 having a length greater than 5 feet, 8 feet, 10 feet, 12 feet, 15 feet, 20 feet, or more.

Also note that although this embodiment describes an encasing structure 101 having two portions 102, 104, in other embodiments, the encasing structure 101 may consist of only one portion or more than two portions of different or the same shapes, sizes, materials, and configurations. Different portions of a multi-portion package may be secured to one another, the luminaire, and/or other portions of the lighting device by connectors, through an interference fit, a surrounding structure or encasement, and/or any other suitable means. Alternatively, the portions may not be secured together or to other structure in some embodiments.

In the embodiment of FIGS. 1 and 2, the inside 112 of each of the portions 102, 104 of the encasing structure 101 is configured or shaped so that, once encased, the luminaire 108 of the lighting device 106 will be partially or completely surrounded by protective packaging materials. The invention is not limited to any particular size, shape, configuration, material, type, or style of packaging or protection. The inside 112 of each of the portions 102, 104 of the encasing structure 101 may be made of any suitable material and shaped to generally match or conform to the outer shape of the luminaire 108.

The first portion 102 and the second portion 104 of the encasing structure 101 of the package are also each configured to form respective semi-circles 114*a*, 114*b* on one end. The respective semi-circles 114*a*, 114*b* come together to form a circular aperture 116 when the package is installed around the luminaire 108 of the lighting device 106, as shown in FIG. 2. The pole 110 extends through aperture 116. In some embodiments, the aperture will have a shape and size similar to the shape and size of a cross section of the pole. In other embodiments, the aperture will have a different shape and size. For example, the aperture may be larger than the cross section of the pole of a lighting device.

The portions 102, 104 of the encasing structure 101 may only partially surround the luminaire 108, and may surround a portion or all of the pole 110. As explained in greater detail below, the portions 102, 104 may also be configured such that the package can be secured, connected, or attached to another package or lighting device component such as a pole. The encasing structure configuration, whether including one or more portions, may include one or more package recesses 118, projections, and/or pole recesses 120*a*, 120*b*, 120*c*, 120*d*, that work alone or in combination with other components to secure, attach, connect, or otherwise hold packaging or a lighting device.

One embodiment of the present invention is a method of packaging a lighting device comprising encasing a luminaire of the lighting device with portions of an encasing structure of a package, wherein a pole of the lighting device extends through an aperture.

Exemplary Embodiment of Multi-Packaged Lighting Devices

Interlocking Package to Package

Figure 3:
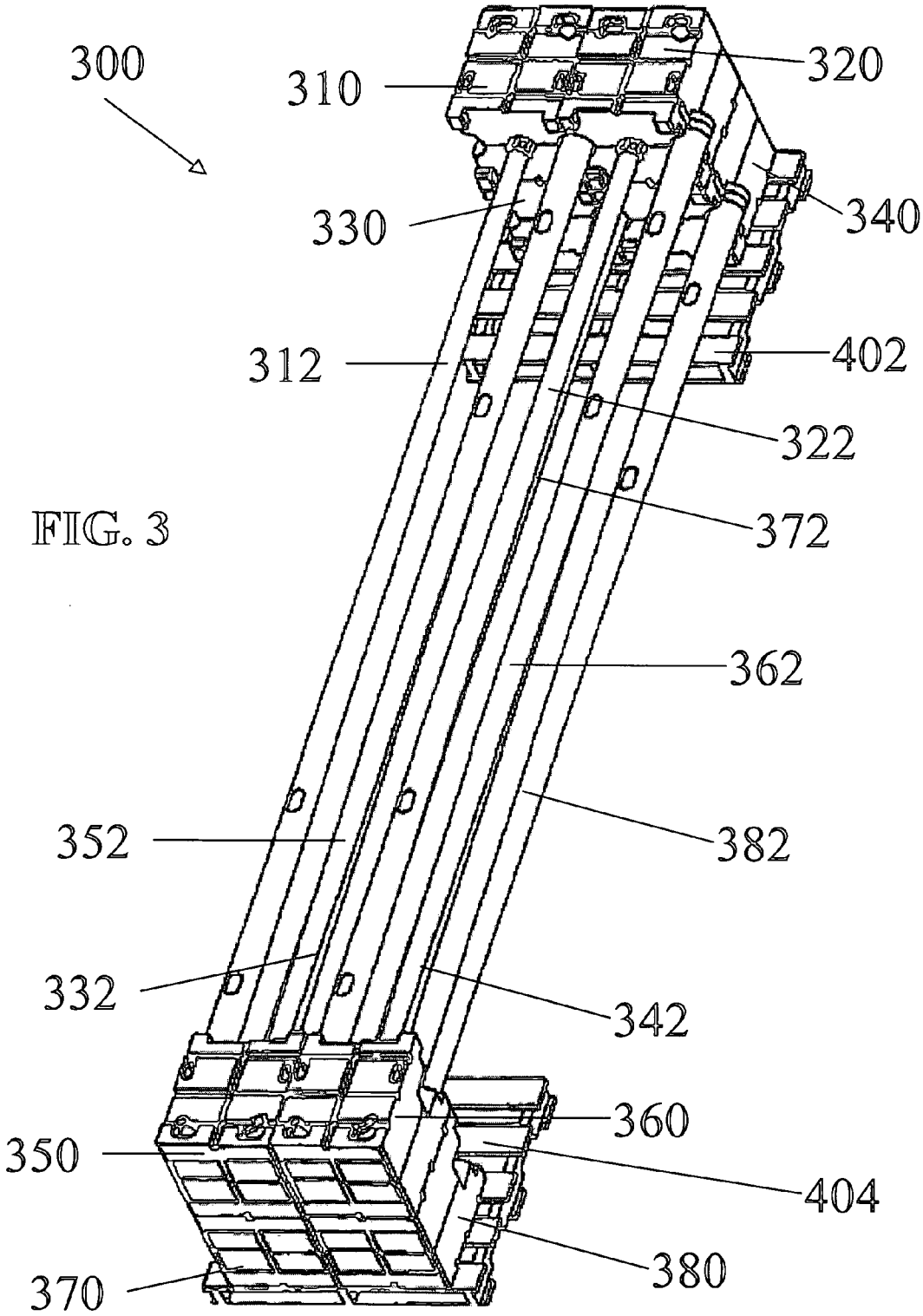
FIG. 3 shows an exemplary bundle of packaging for lighting devices in accordance with an embodiment of the present invention.

FIG. 3 shows a bundle 300 or multi-pack of eight packaged lighting devices 310, 320, 330, 340, 350, 360, 370, 380. A first set of packaged lighting devices 310, 320, 330, 340 have packaged luminaires on a first pallet 402, while a second set of the packaged lighting devices 350, 360, 370, 380 have packaged luminaires on a second pallet 404. The packaging of the first set of packaged lighting devices 310, 320, 330, 340 on one end of the bundle may interact with one another such that they are secured, connected, or otherwise held together.

Referring again to FIGS. 1 and 2, an individual package encasing structure 101 may include one or more recesses 118 and one or more projections for securing, connecting, or attaching to a neighboring package in a lighting device bundle.

Referring now to FIG. 3, package 310 may be connected to package 320 by the interaction of a recess and projection (not shown). Accordingly, in some embodiments, the encasing structure of a package may also include an outer surface configured to interlock with a corresponding recess in the outer surface of the encasing structure of another lighting device package. Different packages of a bundle 300 may be secured to one another by a connector, interference fit, surrounding structure, encasement, or shrink wrap, and/or any other suitable means. Alternatively, the packages may not be secured together.

Referring again to FIGS. 1 and 2, one embodiment of the present invention is a method of packaging a lighting device. The method comprises encasing a luminaire 108 of the lighting device 106 with encasing structure 101 of a package, wherein a pole 110 of the lighting device 106 extends through an aperture 116 in encasing structure 101, and interlocking encasing portions 102, 104 of the package with the encasing portions of a second lighting device package by fitting a projection on an outer surface of one of encasing portions 102, 104 with a corresponding recess in the outer surface of an encasing portion of the second lighting device package.

Interlocking Pole to Package

Referring now to FIG. 3, the two ends of the bundle 300 of lighting device packages 310, 320, 330, 340, 350, 360, 370, 380 may be connected, attached, or otherwise secured through an interaction between the poles of the devices on one end with the packages on the other end. The respective poles 312, 322, 332, 342 of the first set of packaged lighting devices 310, 320, 330, 340 extend and interact with the second set of packaged lighting devices 350, 360, 370, 380. In a similar manner, the respective poles 352, 362, 372, 382 of the second set of packaged lighting devices 350, 360, 370, 380 extend and interact with the first set of packaged lighting devices 310, 320, 330, 340. Accordingly, the two sets of packaged luminaires interact to form a bundle 300 or multi-pack of packaged luminaire devices 310, 320, 330, 340, 350, 360, 370, 380 that can be set on two pallets 402, 404.

Referring now to FIGS. 1 and 2, encasing portions 102, 104 may be configured to allow for the pole to package interactions illustrated in FIG. 3. In FIGS. 1 and 2, pole recesses 120*a*, 120*b*, 120*c*, 120*d* are used to hold or secure the end of poles in a bundle. In this embodiment, the first portion 102 has a first pole recess 120*a* and a second pole recess 120*b*, and the second portion 104 has a third pole recess 120*c* and a fourth pole recess 120*d*. The pole recesses 120*a*, 120*b*, 120*c*, 120*d* compliment each other when the portions 102, 104 are installed to surround a lighting device 106. Specifically, the first recess 102*a* on the first portion 102 and the third recess 120*c* on the second portion 104 cooperate to form a semicircle. Likewise the second recess 102*b* on the first portion 102 and the fourth recess 120*d* on the second portion 104 cooperate to form a semi-circle. The shape formed is not limited to a semi-circle. Any suitable shape or size may be used to form a recess that is capable of securing or otherwise interacting with the end of the pole of an opposite facing lighting device in a bundle.

The pole recesses 120*a*, 120*b*, 120*c*, 120*d* may also interact with pole recesses of other packaged lighting devices in a bundle. Two semi-circles could be placed adjacent one another to form a whole circle in which the pole of an opposite facing lighting device may be secured. Accordingly, in one embodiment, the package includes a pole recess positioned on the outer surface of the encasing portion such that it interacts with a pole recess on a package of another lighting device to secure the pole of yet another the lighting device.

Referring again to FIGS. 1 and 2, one embodiment of the present invention is a method of packaging a lighting device 106 comprising encasing a luminaire 108 of the lighting device 106 with portions 102, 104 of an encasing structure 101 of a package, wherein a pole 110 of the lighting device 106 extends through an aperture 116 in the portions 102, 104, and securing the pole of a second lighting device with a pole recess on an outer surface of the portions 102, 104.

Another embodiment includes a method of packaging a lighting device 106 comprising encasing a luminaire 108 of the lighting device 106 with an encasing portion 102, 104 of an encasing structure 101 a package, wherein a pole 110 of the lighting device 106 extends through an aperture 116 in the portions 102, 104, and interlocking the package with a plurality of other lighting device packages to form a bundle 300 of packaged lighting devices. As described above, in one embodiment, the bundle 300 of lighting devices forms a structure having encased luminaires on two ends and light fixture poles in the center. In another embodiment, each of the encased luminaires at one end of the bundle is connected to a pole secured by the encasing portion of the luminaires at the other end of the bundle. In yet another embodiment, the two ends of the bundle are placed on separate shipping pallets.

Yet another embodiment includes a method of packaging a lighting device that involves encasing the luminaire, but not the pole, with a package, and interlocking the package with a plurality of other lighting device packages to form a bundle. The bundle of packaged lighting devices may be then shipped, delivered, displayed, and/or stored until the individually packaged lighting devices are removed from the bundle.

Exemplary Embodiment of a Method of Selling a Lighting Device

Another embodiment of this invention includes a method of selling a lighting device that includes offering a lighting device for sale under a single item code wherein the lighting device includes a luminaire preassembled to a pole, accepting an order for the single item code for delivery to a delivery location, and shipping the lighting device to the delivery location. In one embodiment, the lighting device item code will relate to a lighting device having a control unit preassembled with a luminaire and a pole and, in another embodiment, it will identify a lighting device that is fully assembled. It is not necessary to use an item code in some embodiments of this invention. In some embodiments, the order for the lighting device will be made by reference to a trade name or other identifying information for the lighting device.

Advantages

Some embodiments of the of the present invention may save a lighting device customer or installer a large amount of time and expense by avoiding or reducing the need to assemble the components of a luminaire required to make the unit operable (i.e., the lamp, pole, photocontrol, etc.). In some embodiments, the luminaire may be shipped and delivered in a preassembled form, such that the pole, lamp, photocontrol, and other components are preassembled, connected, and/or wired together. Accordingly, in many embodiments, a technician or electrician will not be required to wire the lamp, pole, and other components. Moreover, in many embodiments, equipment such as a ladder or bucket truck will not be required to install the luminaire at the top of a pole, since the electrical connections between the lamp, pole, and other components may be done prior to shipment and installation of the luminaire.

Another advantage to some embodiments, is that the same lighting device package may be used to ship luminaires individually and luminaires preassembled with other lighting device components such as a pole. In these embodiments, the shape of the packaging encases primarily the luminaire but allows for a pole to extend outwardly. If no pole is attached, the package simply encases the luminaire.

ALTERNATIVE EMBODIMENTS

The foregoing description of the exemplary embodiments of the invention has been presented only for the purposes of illustration and description and is not intended to be exhaustive or to limit the invention to the precise forms disclosed. Many modifications and variations are possible in light of the above teaching. The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. For example, embodiments of the invention may include encasing structures having one or more separable portions, one or more semi-attached portions, a single portion, separate portions made of different materials, recyclable materials, materials with holes, etc. Accordingly, the scope of the present invention is defined by the appended claims rather than the foregoing description and the exemplary embodiments described therein.

What is claimed is:

1. A package for a lighting device comprising:

an encasing structure that surrounds at least a portion of a luminaire of the lighting device; and an aperture in the encasing structure through which a pole connected to the luminaire extends;

wherein an outer surface of the encasing structure includes a projection for connecting to a recess in an outer surface of another lighting device package.

2. The package of claim 1, wherein the encasing structure has a rectangular outer shape.

3. The package of claim 1, wherein the encasing structure has a square outer shape.

4. The package of claim 1, wherein the encasing structure comprises two separable portions.

5. The package of claim 1, wherein the encasing structure completely surrounds the luminaire.

6. The package of claim 1, wherein the aperture is larger than the cross section of the pole.

7. A package for a lighting device comprising:

an encasing structure that surrounds at least a portion of a luminaire of the lighting device; and an aperture in the encasing structure through which a pole connected to the luminaire extends;

wherein the encasing structure includes a pole recess for securing a pole of another lighting device.

8. The package of claim 7, wherein the pole recess is positioned on the outer surface of the encasing portion such that it interacts with a pole recess on a package of a third lighting device to secure the pole of the second lighting device.

9. The package of claim 7, wherein the encasing structure has a rectangular outer shape.

10. The package of claim 7, wherein the encasing structure has a square outer shape.

11. The package of claim 7, wherein the encasing structure comprises two separable portions.

12. The package of claim 7, wherein the encasing structure completely surrounds the luminaire.

13. The package of claim 7, wherein the aperture is larger than the cross section of the pole.

14. A method of packaging a lighting device comprising:

encasing a luminaire of the lighting device with an encasing structure of a package, wherein a pole of the lighting device extends through an aperture in the encasing structure; and interlocking the encasing structure of the package with a second encasing structure of a second lighting device package by fitting a projection on an outer surface of the first encasing structure with a corresponding recess in the outer surface of the second encasing structure.

15. A method of packaging a lighting device comprising:

encasing a luminaire of the lighting device with an encasing structure of a package, wherein a pole of the lighting device extends through an aperture in the encasing structure; and securing a pole of a second lighting device with a pole recess on the encasing structure.

16. A method of packaging a lighting device comprising:

encasing a luminaire of the lighting device with an encasing structure of a package, wherein a pole of the lighting device extends through an aperture in the encasing structure; and interlocking the package with a plurality of other lighting device packages to form a bundle of packaged lighting devices, wherein each of the lighting devices includes an encasing structure around its respective luminaire.

17. The method of claim 16, wherein the bundle of lighting devices forms a structure having encased luminaires on two ends and light fixture poles in the center.

18. The method of claim 17, wherein each of the encased luminaires at one end of the bundle is connected to a pole secured by the encasing structure of the luminaires at the other end of the bundle.

19. The method of claim 17, further comprising placing each of the two ends of the bundle on a separate shipping pallet.

20. A bundle of packaged lighting devices comprising:

a first set of packaged lighting devices connected to one another;

a second set packaged lighting devices connected to one another;

wherein a luminaire of each lighting device is surrounded by an encasing structure and a pole of each lighting device extends from the encasing structure; and wherein the poles of the first set are secured to the second set and the poles of the second set are secured to the first set.

* * * * *